United States Patent [19]

Peppers et al.

[11] Patent Number: 4,628,495

[45] Date of Patent: Dec. 9, 1986

[54] MEASURING WHILE DRILLING APPARATUS MUD PRESSURE SIGNAL VALVE

[75] Inventors: James M. Peppers; Farhat A. Shaikh, both of Houston, Tex.

[73] Assignee: Dresser Industries, Inc., Dallas, Tex.

[21] Appl. No.: 406,741

[22] Filed: Aug. 9, 1982

[51] Int. Cl.[4] ..... G01V 1/40

[52] U.S. Cl. ..... 367/85; 251/282; 367/83; 175/40

[58] Field of Search ..... 367/83-85; 175/40, 48, 50; 166/113, 324, 332; 33/306, 307; 251/282, 324

[56] References Cited

U.S. PATENT DOCUMENTS

| | | | |
|---|---|---|---|
| 3,581,819 | 6/1971 | Tamplen | 166/332 |
| 3,713,089 | 1/1973 | Claycomb | 367/84 |
| 3,800,832 | 4/1974 | Umplenour et al. | 251/282 |
| 4,184,545 | 1/1980 | Claycomb | 367/85 |
| 4,266,606 | 5/1981 | Stone | 367/85 |
| 4,274,445 | 6/1981 | Cooper | 251/282 |
| 4,311,297 | 1/1982 | Barrington | 251/282 |
| 4,340,088 | 7/1982 | Geisow | 166/332 |

*Primary Examiner*—Nelson Moskowitz
*Assistant Examiner*—Ian J. Lobo
*Attorney, Agent, or Firm*—Richard M. Byron

[57] ABSTRACT

A measuring and transmitting apparatus for use in a drill string of a well drilling rig has an elongated tubular member functioning as a drill collar in a drill string. This apparatus includes an instrument having transducers that measure lithological and geophysical parameters in the borehole and derive from them data that is encoded into pressure pulsations of the mud flow of the drill string by a modulated signal generator. The modulated signal generator has a valve assembly that selectively restricts the mud flow to introduce the data. The valve is constructed with a movable valve element that is displaced into an orifice located in the mud flow stream. The movable valve element is mounted in a pressure balanced and an area balanced configuration in order that it can be displaced between extended and retracted positions by a valve actuator without regard to the mud pressure either within the drill string or in the borehole annulus around the drill string.

8 Claims, 13 Drawing Figures

MEASURING WHILE DRILLING APPARATUS MUD PRESSURE SIGNAL VALVE

TECHNICAL FIELD

This invention is related to the valve construction used in the mud flow modulation signal generator of a borehole drilling measurement while drilling apparatus. More specifically the invention is related to a pressure and area balanced valve member used in the mud flow modulation signal generator in the subsurface portion of a measurement while drilling instrument.

BACKGROUND OF THE INVENTION

There are numerous measuring while drilling tools and some of them use a position control valve to encode the measurement into output signals by presure pulse modulating the mud flow. One such apparatus for pressure pulse modulating the mud flow has a valve member immersed in the mud flow and movably mounted to be displaced into a constriction in the mud flow to temporarily change back pressure in the drill string mud flow. Movement of this valve member is accomplished by a valve actuator that must displace the valve member in the mud flow stream in opposition to pressure forces created by the mud flowing downward within the drill string around the instrument and flowing upward within the borehole annulus. In some mechanical configurations of this valve assembly and its associated actuator the presure conditions of the mud can possibly prevent the valve from being properly displaced by the valve actuator and thus prevent the desired transmission of data from the measurement while drilling downhole instrument to the earth's surface through the mud flow path. Depending upon the mechanical configuration used the problems associated with pressure conditions affecting this valve assembly can result in inaccurate or erractic data transmission. Under certain pressure conditions the valve member can be pressure locked thus immovable and when this occurs no data transmission occurs.

SUMMARY OF THE INVENTION

In an embodiment of this invention a measurement while drilling downhole instrument is provided with a valve assembly operable to create pulsations in the back pressure of the mud flow through a drill string in which the instrument is installed. The valve assembly includes a valve member within the instrument that is constructed to be displaced longitudinally. This valve assembly is constructed to be pressure balanced with respect to mud pressures above and below the valve as generated by mud within the drill string while the valve is in either the open or closed positions. The valve assembly is also area balanced with respect to the hydraulic actuating fluid areas.

DETAILED DECRIPTION OF THE PREFERRED EMBODIMENT

Figure 1:
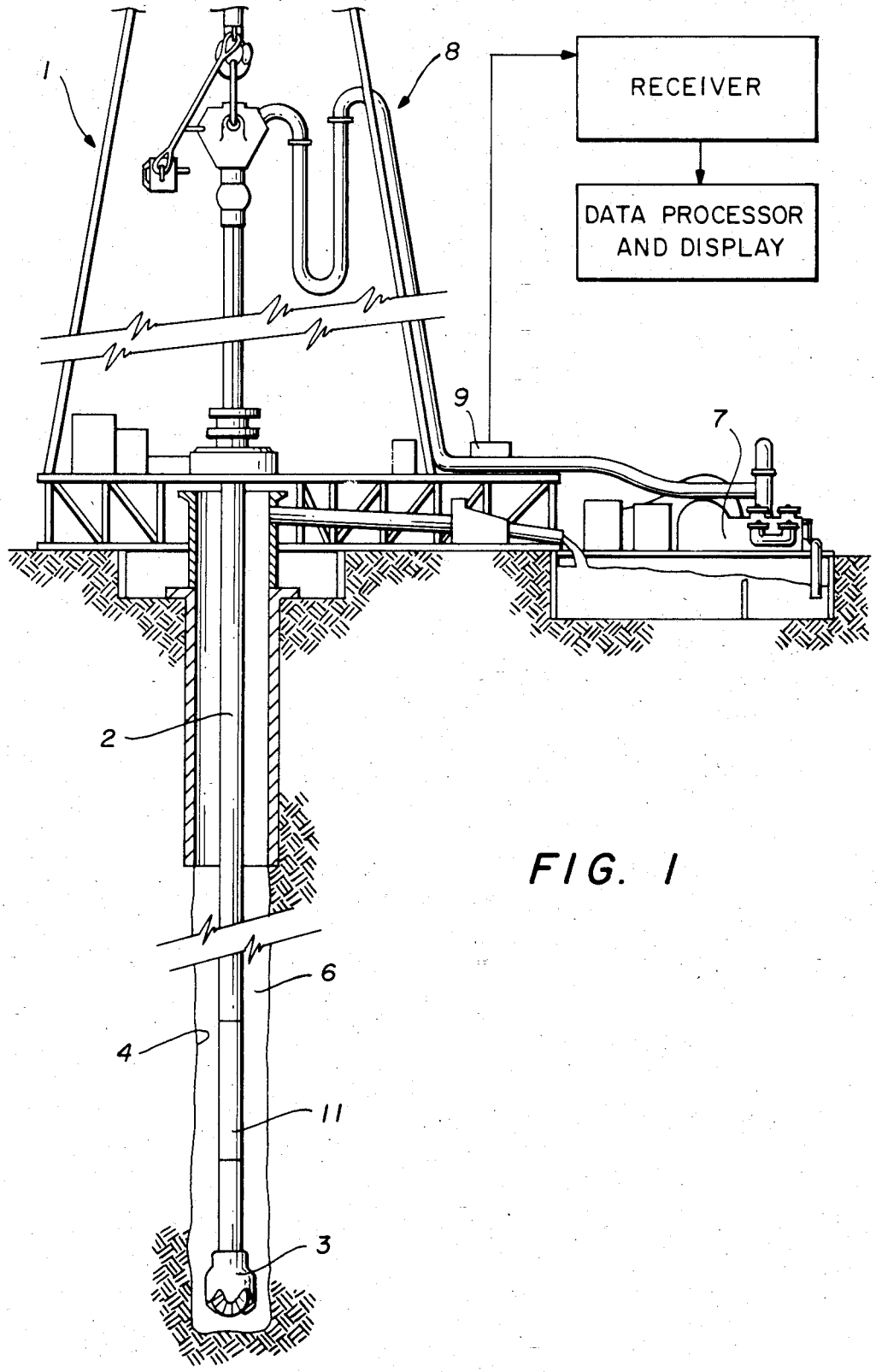
FIG. 1 is a schematic and pictorial representation of a earth borehole drilling rig having a measurement while drilling system incorporating this invention.

The apparatus of this invention can be used in a borehole measurement while drilling system that is incorporated with a drilling rig such as that illustrated in FIG. 1. As shown, the measurement while drilling system is used with a conventional rotary type drilling rig, indicated generally at 1, wherein a drill string 2 is comprised of a plurality of segments of drilling pipe and the drill collars joined together and having a drilling bit 3 at the lower end thereof. The drill string is rotated to drill a borehole 4 through the earth formations.

The measurement while drilling system includes a downhole apparatus with a sensor package and a transmitter located within a special instrument carrying drill collar 5 positioned above drilling bit 3 in the drill string. Surrounding drill string 2 is a borehole annulus 6 that is filled with drilling fluid or mud flowing upward and returning to the earth's surface. At the earth's surface a drilling fluid or mud pump 7 circulates the mud or drilling fluid used in the drilling operation by removing it from a mud storage tank or pit and passing it through a series of conduits indicated generally at 8 to a swivel at the upper end of the drill string.

The mud flows downward through the interior of the drill string including through the instrument carrying drill collar 11 and exits at drill bit 3 to enter borehole annulus 6 and return to the earth's surface where it flows into a mud storage tank or pit. The transmitting apparatus of the downhole instrument creates fluid presure pulsations in the mud flow or column contained within drill string 2. These pressure pulsations are measured at the earth's surface by a sensor system 9 connected to conduit 8. A receiver is connected to sensor system 9 and operable to extract the intelligence carrying data from this signal for use in a data processing apparatus and display apparatus.

Figure 2:
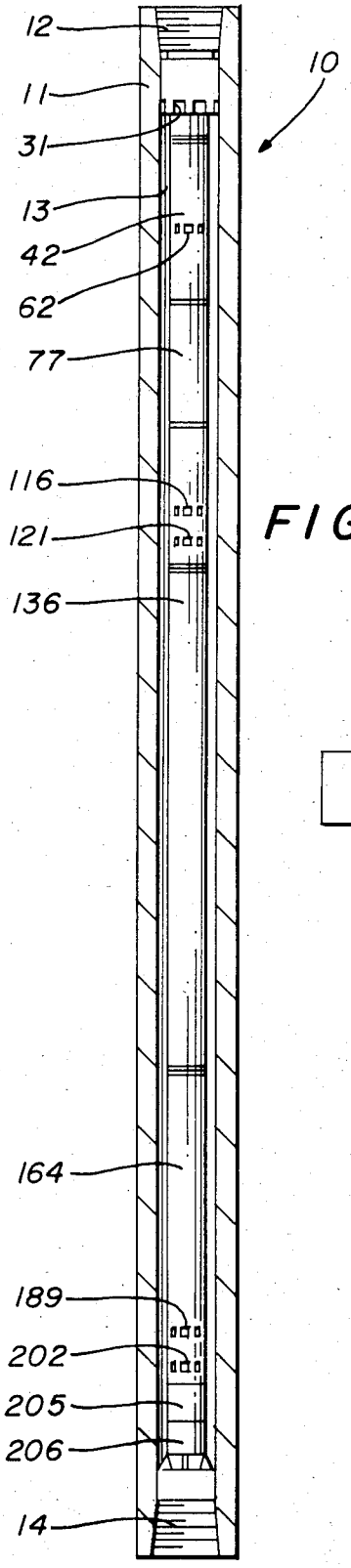
FIG. 2 is a sectional view through the outer wall of the drill collar containing the downhole measurement while drilling instrument.

Attention is now directed to FIG. 2 of the drawings wherein the downhole measuring while drilling instrument indicated generally at 10 is shown within its associated drill collar. This instrument 10 in its total downhole package functions mechanically as a drill collar in the drill string. The instrument 10 as illustrated includes the instrument carrying drill collar 11 with threaded connections 12 and 14 at its upper and lower ends respectively. The interior of the drill collar is provided with mountings at its upper and lower end portions to secure the elongated tubular instrument enclosure in a spaced relation to the interior wall forming a drill string annulus 13 extending the length of the instrument through which the mud can flow.

Attention is now directed to FIG. 4 where the tool will be described in greater detail beginning at its upper end portion illustrated. Instrument carrying drill collar 11 that encloses the instrument package is constructed of a non-magnetic material, such as the MONEL metal alloy, to avoid interference with magnetic sensing devices that may be included in the instrument sensor package.

Mud passing through the drill string enters instrument drill collar 11 at its upper end and passes into the upper end of the instrument or tool. A sleeve 15 is snugly fitted to the interior of drill collar 11 contacting its interior wall 17. Sleeve 15 is internally threaded at its upper end portion and receives a hollow mud inlet fitting 16. Mud inlet fitting 16 has a mud inlet sleeve 18 mounted therein and extending over its upper end portion. Mud inlet sleeve 18 is provided with a funnel shaped interior passage at its upper end as illustrated.

Immediately below inlet sleeve 18 is a turbine assembly 22 that receives a portion of the mud flowing through inlet sleeve 18. Turbine assembly 22 is smaller in diameter than the interior of sleeve 15 and it is positioned with its inlet spaced apart from the outlet of mud inlet sleeve 18 so that a portion of the mud flow is passed through the turbine assembly by pasing around its exterior. The turbine assembly includes a plurality of nozzles 26 oriented to direct the mud flow radially outward in a direction to cause rotation of turbine assembly 22. A support shaft 24 is rigidly connected with turbine assembly 22 and mounted from below in a bearing assembly.

A mud seal 27 is mounted around shaft 24 below turbine assembly 22. A seal ring 28 is positioned below mud seal 27 around shaft 24 and supported at the upper end portion of tubular housing 29. Tubular housing 29 is conically shaped on the exterior of its upper end portion to direct or divert the mud flow in an outward direction through openings in the housing into drill string annulus 13. Sleeve 15 extends downwardly over the upper portion of tubular housing 29 and contains a plurality of spaced apart alignment fins 30 between which are formed openings 31 for the mud flow into drill string annulus 13.

A pair of bearing sets 34 are contained within the interior of tubular housing 29 and rotatably mounted to support shaft 24. A tubular member 39 is mounted to the lower end portion of tubular housing 29 by tubular skirt 37 that is threadedly mounted in the interior of tubular housing 29. A cylindrical housing 42 is joined to the lower portion of tubular member 39 and extends downward therefrom forming an exterior portion of the instrument's housing.

The interior of tubular member 39 encloses a shaft housing 44 positioned concentrically around a reduced diameter portion of shaft 24. The interior of the instrument housing within cylindrical housing 42 and around shaft 24 below seal ring 28 defines a cavity 46. Cavity 46 is filled with lubricating oil and it is pressurized by the drill string annulus mud pressure acting on floating pressure seal assembly 43 and shown in the upper portion of FIG. 4B.

Figure 4A:
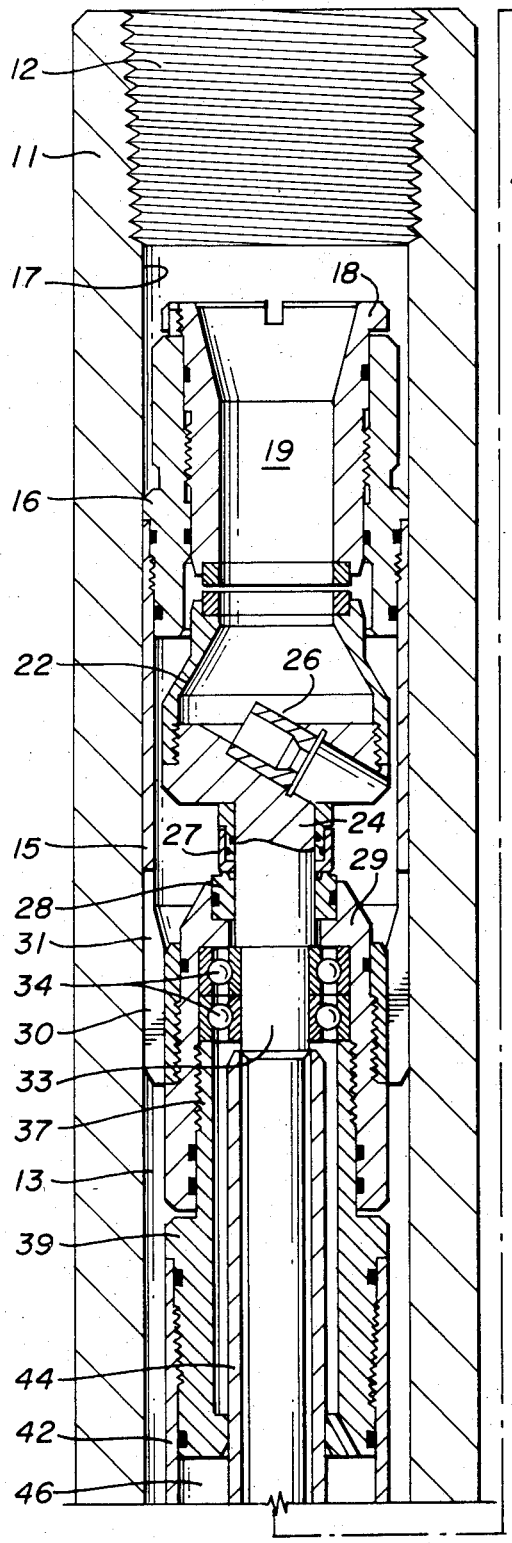
FIG. 4 is a sectional view of the instrument taken in segments 4A–4H, inclusive, illustrating structural details of the instrument including the preferred embodiment of the valve assembly in a retracted position.
Figure 4B:
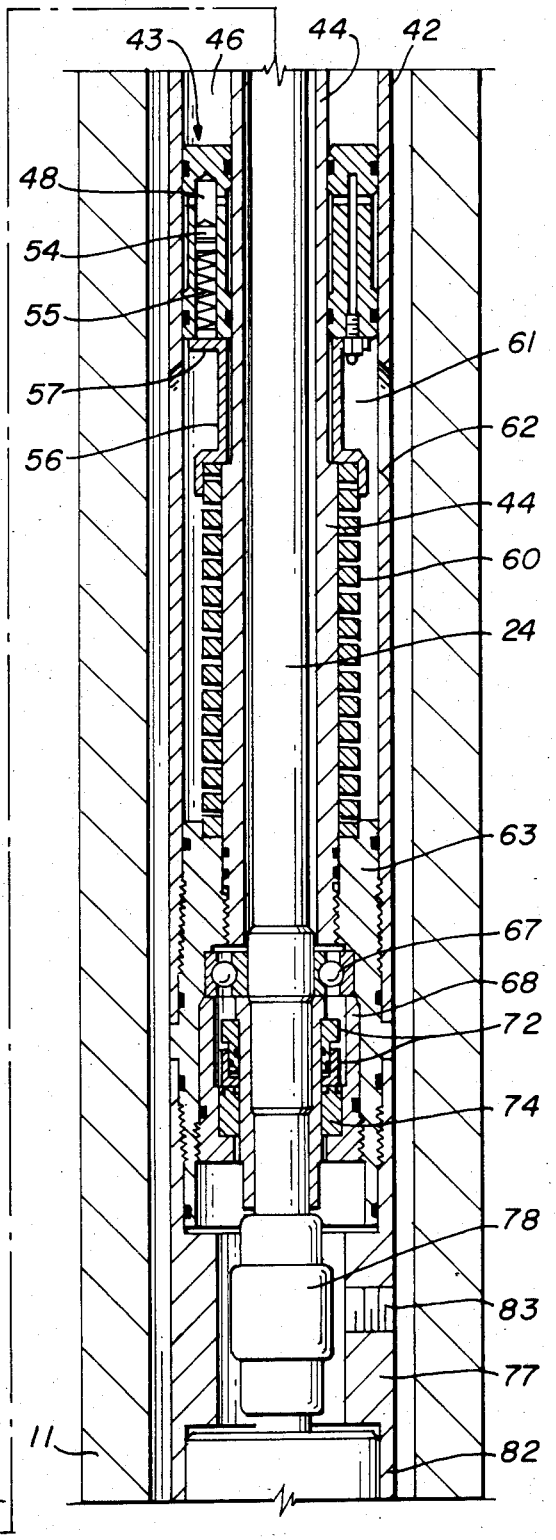

In the upper portion of FIG. 4B floating pressure seal assembly 43 is located between the exterior of shaft housing 44 and the interior of cylindrical housing 42. Floating pressure seal assembly 43 is provided with a plurality of internal passageways forming a pressurized reservoir 48 that is filled with packing grease that communicating with shaft housing 44 and cylindrical housing 42 in order to provide a fluid tight and yet longitudinally movable seal between opposite sides of the seal assembly. In communication with the grease reservoir 48 is a movable plug 54 urged by a coil spring 55 to maintain a compressive load on grease contained within reservoir 48.

Below floating pressure seal assembly 43 is a spool like bushing 56 positioned around shaft housing 44 and having a outwardly extending shoulder 57 on its upper end portion to contact the lower end of floating pressure seal assembly 43. The downward motion limit of bushing 56 is determined by a shoulder around the exterior of shaft housing 44. The lower end portion of bushing 56 is flared and extends around the upper end portion of a coil spring 60 mounted around shaft housing 44. Coil spring 60 is compressed to provide an upwardly directed biasing force exerting against floating pressure seal assembly 43 to pressurize lubricating oil in cavity 46.

The interior of cylindrical housing 42 around coil spring 60 and below floating pressure seal assembly 43 defines a mud filled cavity 61 that is in open communication with drill string annulus 43 by the plurality of ports 62 in tubular housing 42. The lower end of mud filled cavity 61 is terminating at fitting 63 which is threadedly and sealably mounted between shaft housing 44 and cylindrical housing 42. A roller bearing 67 is mounted within the hollow interior of fitting 63 and on to the lower end portion of shaft 24 as illustrated. A bearing retainer 68 is threadedly mounted in the interior of fitting 63 with an end portion abutting roller bearing 67 to retain it in a fixed position. A seal assembly is also contained within bearing retainer 68 and it includes a pair of rotating seals indicated at 72 above an oil seal 74 positioned in surrounding relation to a sleeve over the end portion of shaft 24. This seal assembly forms the lower end of oil filled cavity 46.

The lower portion of fitting 63 is mounted with a tubular housing extension member 77 extending downwardly therefrom and enclosing other components of the instrument. The lower end of shaft 24 joins a shaft coupling 78 that in turn joins the drive shaft of an alternator 82. Alternator 82 is illustrated spanning FIGS. 4B and 4C. Altenator 82 is the electrical generating power source for the electrical components of the instrument.

Figure 4C:
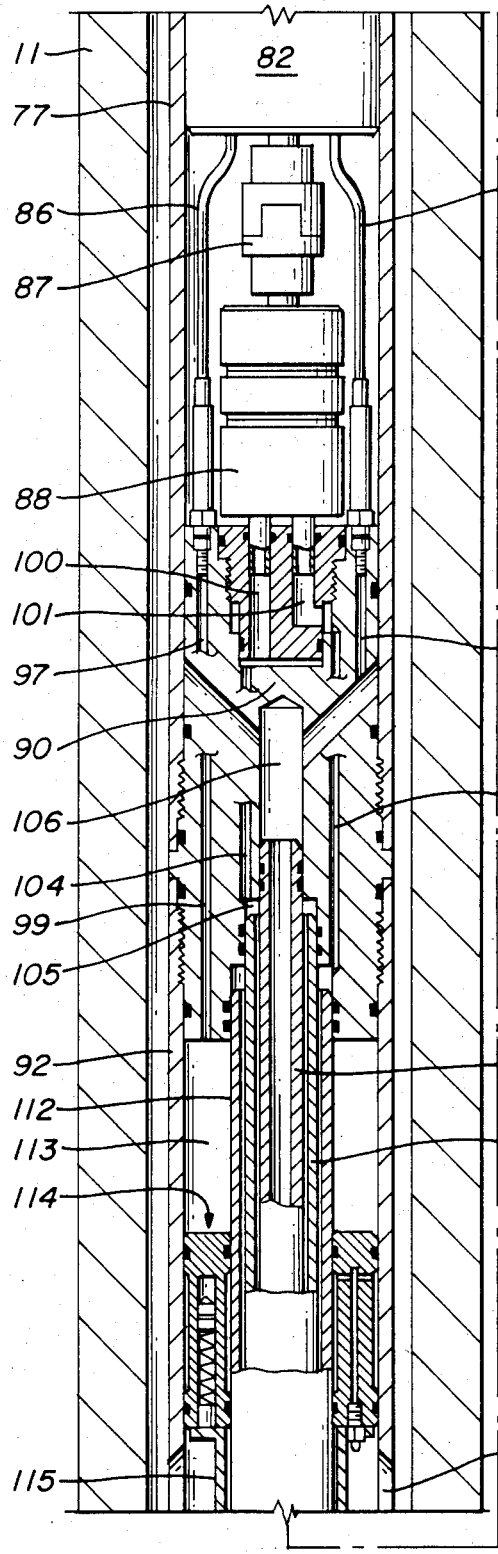

Attention is now directed to FIG. 4C illustrating the alternator, a hydraulic pump and associated hydraulic circuitry components of the instrument. Alternator 82 is positioned within tubular housing segment 77. The drive shaft of alternator 82 extends through the alternator and is connected by coupling 87 with oil pump 88. Oil pump 88 is connected by inlet and outlet conduits to a manifold plug member 90 positioned therebelow. Manifold plug 90 contains several passageways to provide inlet and outlet fluid communication to pump 88 and to provide passages for electrical conductors from alternator 82.

Electrical conductors from alternator 82 are contained in sealed conduit assemblies 85 and 86 exiting the lower portion of the alternator and connecting to the upper end of manifold plug 90 where these wires can enter cable conductor passages 97 and 98. These passages connect with a single axially disposed cable passage 106 in manifold plug 90. A cable conduit 110 is positioned within cable passage 106 and extends downward therefrom to convey the electrical conductors to portions of the instruement therebelow. In order to simplify the drawings these electrical conductors or wires are not shown in their complete length.

Manifold plug 90 includes a low pressure pump inlet passage 101 and a high pressure pump outlet passage 100. Three concentrically placed conduits are mounted in the lower portion of manifold plug 90 and extend therebelow. The innermost conduit is cable conduit 110, a second conduit 111 having an annular shape surrounds cable conduit 110 and is spaced therefrom forming a high presure oil passage therebetween. A third conduit 112 having an annular shape surrounds second conduit 111 and is spaced therefrom defining a low pressure oil passage therebetween.

The low pressure oil passage between second conduit 111 and third conduit 112 is communicated by a low pressure pump inlet passage through manifold plug 90 with pump inlet 101. The high pressure oil passage between cable conduit 110 and second conduit 111 is communicated by groove 105 and passage 104 in manifold plug 90 with pump outlet passage 100. An oil filled cavity 113 is formed below manifold plug 90 and above a sealed assembly, indicated generally at 114. Oil passage 99 through manifold plug 90 communicates between oil filled cavity 113 and the upper end of manifold plug 90 for lubrication purposes. Alternator 82 and pump 88 are contained within a bath of lubricating oil for lubricating purposes and for cooling.

Oil filled cavity 113 is a pressurized oil filled cavity communicating with the cavity containing alternator 82 and pump 88 through oil passage 99. Due to structural configurations and geometric limitations in the drawing oil passage 99 is shown as terminated at a mid point of manifold plug 90 however this passage continues to the upper end of this manifold plug. Seal assembly 114 is constructed similar to seal assembly 43 described above and it provides an axially movable seal assembly separating the oil in cavity 113 from mud contained in the cavity immediately therebelow.

Figure 4D:
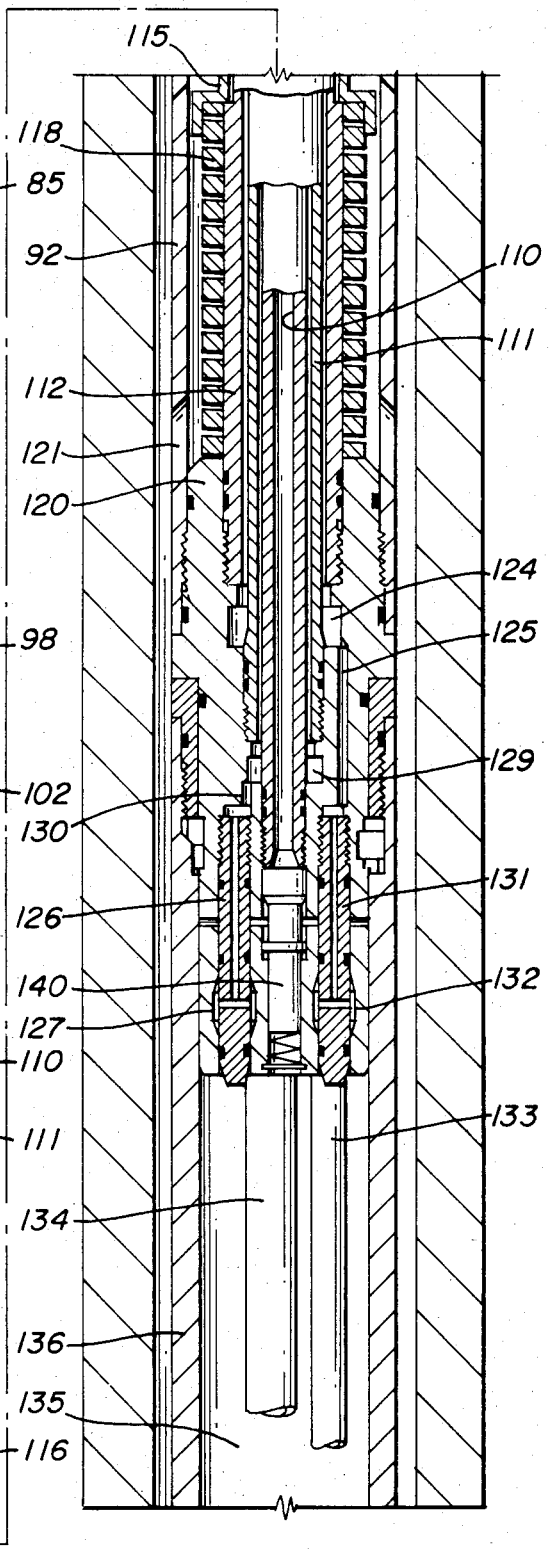

A spool like bracket 115 connects with the bottom portion of seal assembly 114 and is urged in the upward direction by a coil spring 118 positioned around third conduit 112 as shown in the upper portion of FIG. 4D. Ports 116 are provided through tubular housing segment 92 for mud access to the cavity below seal assembly 114. At the lower end portion of tubular housing segment 92 a connective plug 120 functions to threadedly join tubular housing segments 92 and 136 and provide a fluid manifold as well as other physical support. Cable conduit 110, second conduit 111, and third conduit 112 are sealably mounted in the interior of connective plug 120. Spring 118 rests on a shoulder at the upper end of connective plug 120. A plurality of ports 121 are provided around the lower end portion of tubular housing segment 92 just above the upper end portion of connective plug 120. The annular low pressure passageway between second conduit 111 and third conduit 112 communicates through connective plug 120 by joining an annular cavity 124, a longitudinally disposed conduit 125, a hollow insert member 131, another annular cavity 132 and exiting plug 120 at an outlet connected to a low pressure tube 133. The annular high pressure fluid cavity between cable conduit 110 and second conduit 111 passes through connective plug 120 by joining an annular high presure cavity 129, a longitudinally disposed high presure cavity 130, a hollow insert member 126, another annular cavity 127 and exiting conenctive plug 120 at a high pressure tube 134.

A electrical socket 140 is located within connective plug 120 to provide a receptacle for joining the electrical wires passing through the interior of cable conduit 110. For clarity in the illustration of FIG. 4 these wires are not shown. Immediately below connective plug 120 is a cylindrical container enclosing an electronics package indicated generally at 135.

The specific electronic equipment contained in electronics package 135 is not described herein because it is not particularly relevant to this invention. The electronic equipment for downhole logging purposes is believed to be well known in the art. Several variables can be measured by transducers, sensors and the like contained in such electronic equipment and these measurements encoded into electronic signals used by an electrically powered valve operator desribed hereinbelow. Electronics package 135 is located in the portion of this instrument spanning FIGS. 4D and 4E in the drawings.

Figure 4E:
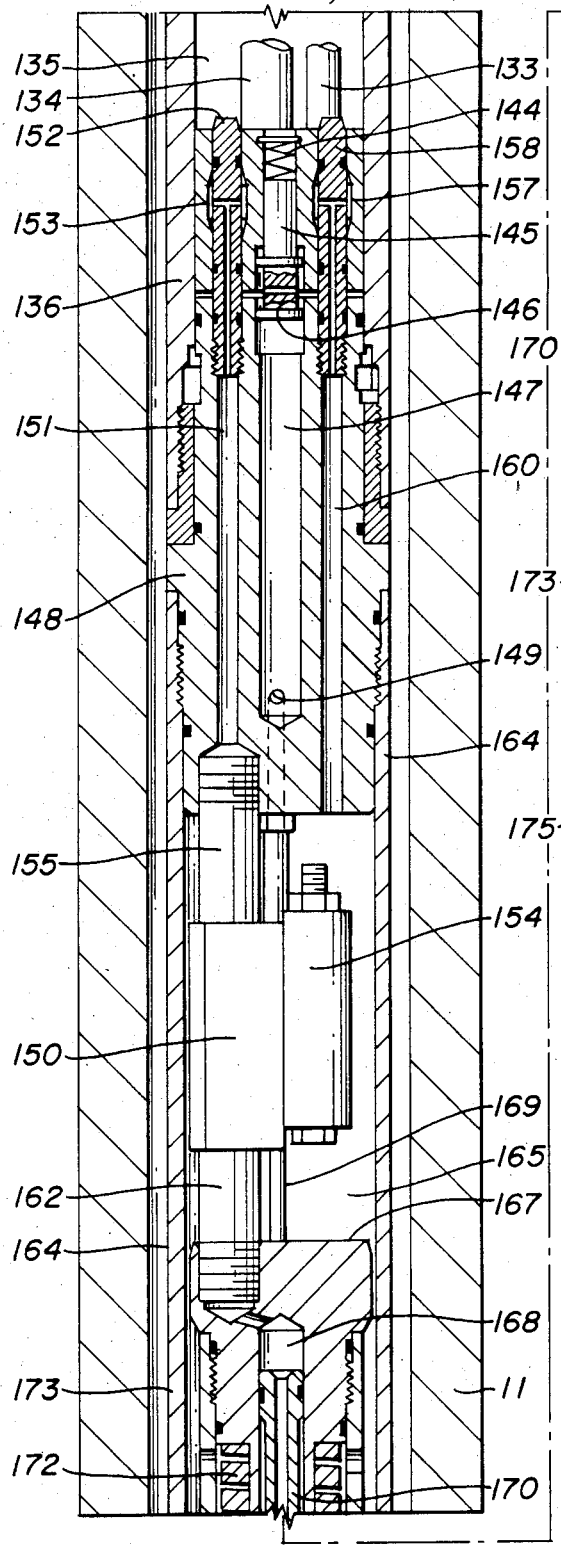

Referring to FIG. 4E at the upper portion electronics package 135 rests on the upper end of a lower body plug 148. Lower body plug 148 connects tubular housing segment 136 and another tubular housing segment 164 extending therebelow and provides support and pasageways for communicating elements of the hydraulic circuit and electrical circuit. Electrical signal carrying wires from electronics package 135 extend through an axially disposed passageway 147 in lower body plug 148 wherein a socket body 145 and connecting plug 146 are located. From connecting plug 146 wires attached thereto can pass through passage 147 and connecting passage 149 to enter chamber 165 below body plug 148.

Figure 3:
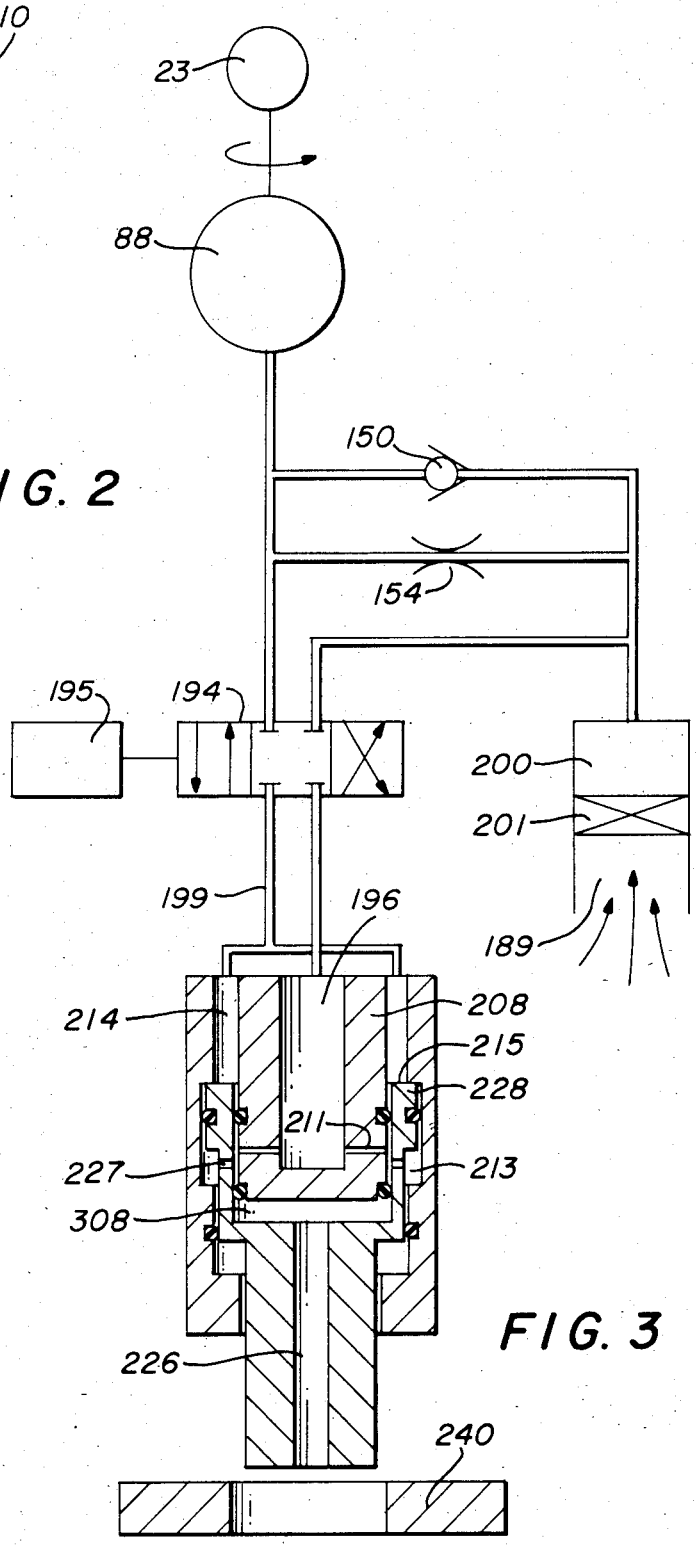
FIG. 3 is a schematic diagram of the hydraulic circuit illustrating the elements used to displace the valve member.

A check valve 150 is connected in parallel with a fluid flow restricter 154 located in chamber 165. Check valve 150 and flow restrictor 154 are connected in the hydraulic circuit as illustrated in FIG. 3. The high pressure fluid in passage 134 connects with lower body plug 148 joining high pressure annular cavity 153 and passing through other connecting passages to a high pressure internal passage 151 in lower body plug 148. A high pressure tubing 155 connects check valve 150 and restrictor 154 in fluid communication with high pressure fluid.

Low pressure or return fluid in low pressure tube 133 connects with lower body plug 148 and joins low pressure annular cavity 157. A hollow connector member then connects this fluid path to low pressure passage 160. Low pressure passage 160 opens to the lower end of lower body plug 148 whereupon it communicates with a cavity or chamber 165 within a portion of tubular housing segment 164. This chamber 165 is open around several lower portions of the instrument below body plug 148 as illustrated.

Below check valve 150 an outlet conduit 162 from the valve connects it with a junction fitting 167 that is smaller in diameter than the interior of tubular housing segment 164. Junction fitting 167 is mounted with the upper end portion of a third tubular member 173 that is also smaller in diameter than the interior of tubular housing segment 164. The interior of junction fitting 167 is provided with an axial and internal bore 168 forming a passageway for high pressure fluid from check valve 150 and providing a cylinder in which a tubular connector 170 moves longitudinally of the instrument.

Figure 4F:
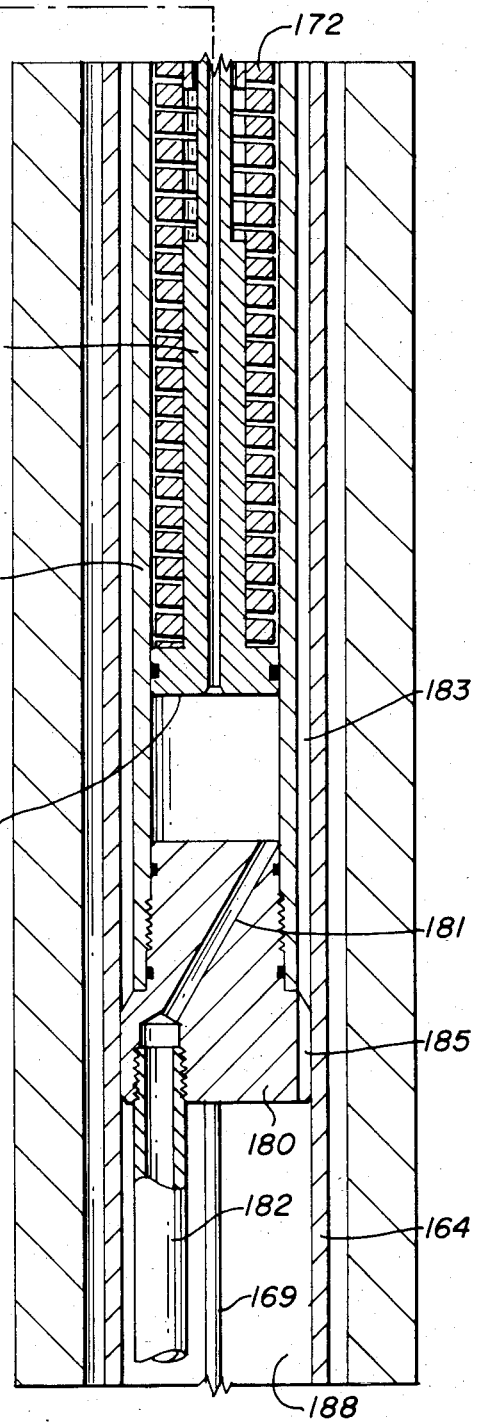

Tubular member 170 is positioned within third tubular member 173. A spring 172 is positioned between the upper end of piston portion 175 and the lower side of junction fitting 167 biases tubular member 170 to an extended position or a downwardly disposed position as shown in FIGS. 4E and 4F. Within the interior of tubular housing segment 164 a wire enclosure member 169 is attached to the interior of the housing segments sidewall with electrical wires therethrough along side third tubular member 173 and the elements attached thereto. Wire enclosure 169 extends downward to electrically controlled valve operator 195 visible in FIG. 4G.

Referring to FIG. 4F the lower portion of third tubular member 173 is sealably mounted with a plug 180. A passageway 181 through plug 180 connects a chamber formed within third tubular member at the upper end of plug 180 to a conduit 182 extending from the bottom of plug 180. Conduit 182 passes high pressure hydraulic fluid to the control valve below. Fins 185 around the lower end outer peripheral portion of plug 180 support it centrally within tubular housing semgent 164 and provide for the passage of low pressure fluid around the exterior of third tubular member 173.

Figure 4G:
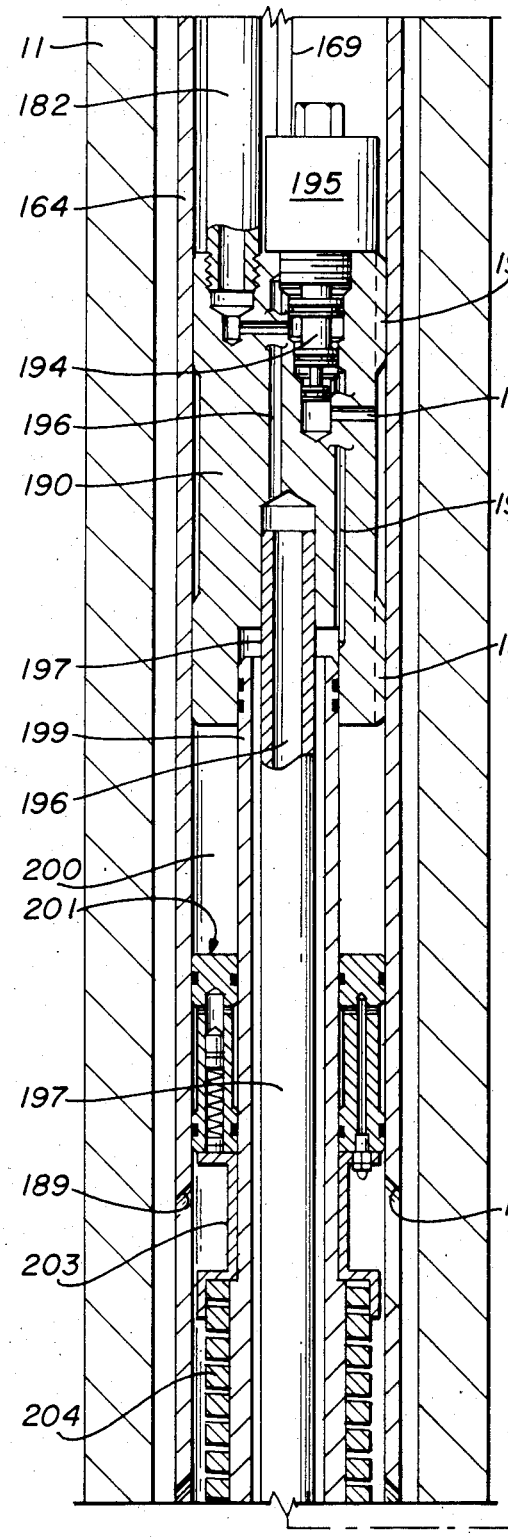

Referring to FIG. 4G wherein high pressure valve inlet conduit 182 is mounted with a valve body and manifold member 190. This valve manifold has a plurality of ribs 192 spaced around its upper end portion and a similar plurality of ribs 193 spaced around its lower portion to provide for low pressure fluid communication therearound. Electrical valve operator 195 is mounted at the upper end portion of valve manifold 190 and operably connected to spool valve member 194. This valve has two input sources; one from the high pressure fluid supplied by valve inlet conduit 182 and the other from low presure fluid in the interior of tubular housing segment 164. Low pressure fluid passes to the valve through transversely disposed conduit 191. The valve has two output flow paths with the first one being through output passage 196 and the second being through valve output passage 198. The valve outputs are connected to concentric conductors 197 and 199 both of which are longitudinally slidably mounted in the lower portion of valve manifold 190.

It should be observed that high pressure fluid is contained within passage 196 in valve manifold and within conduit 197 and also within the annular space between conduits 197 and 199. Low pressure fluid is contained within tubular housing segment 164 surrounding conduit 199, valve manifold 190 and other components contained within tubular housing segment 164 up to lower body plug 148. Within tubular housing member 164 (which contains the lower pressure fluid) effectively forms a hydraulic accumulator cavity indicated generally at 200 in FIG. 4G. At the lower portion of this hydraulic accumulator is a movable seal assembly indicated generally at 201. Seal assembly 201 is similar to seal assemblies 114 and 43 described above and is longitudinally movable within the tubular housing member. A plurality of ports 189 provide access to mud at the drill string pressure to the bottom side of seal assembly 201.

Spool like bracket 203 is mounted at the upper end of a coil spring 204 to urge seal assembly 201 in the upward direction. Additional force is provided to urge seal assembly 201 in the upward direction by mud presure exerted on the lower side of the seal assembly. This mud pressure accesses the interior of tubular housing member 164 through ports 189 and port 202. Port 202 is shown in the upper portion of FIG. 4H.

Figure 4H:
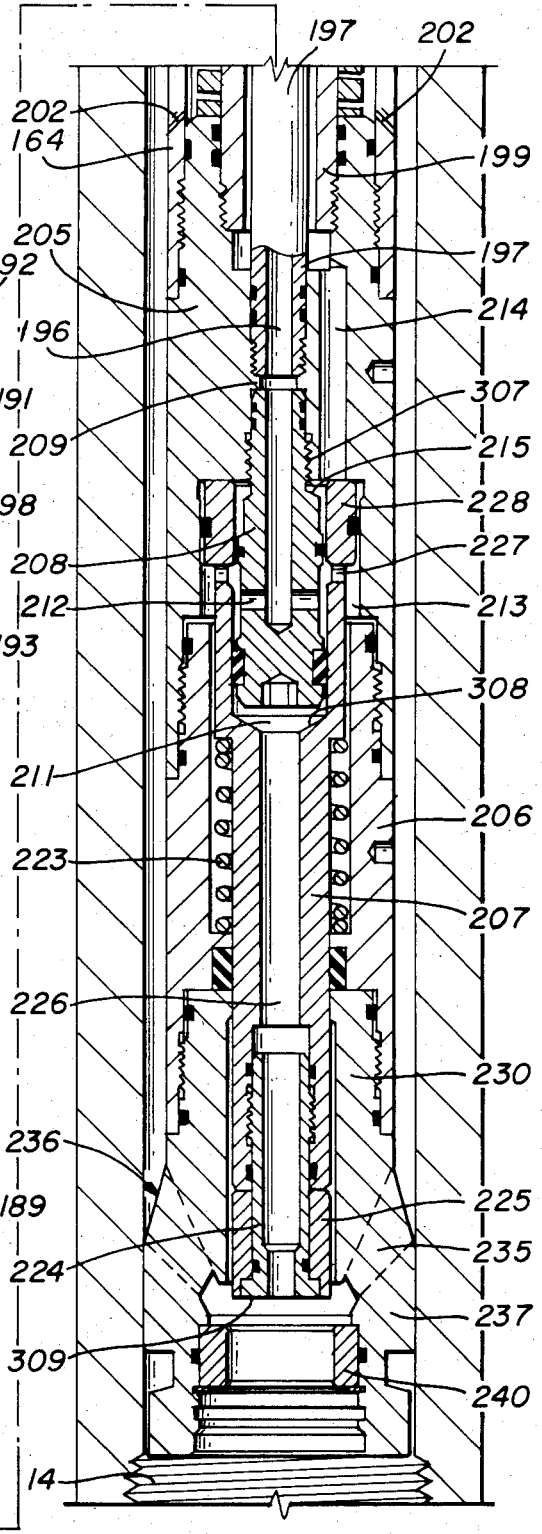

Referring now to FIG. 4H which shows the lower end segment of this instrument and its associated drill collar. The lower end portion of tubular housing 164 connects to a support sub 205. Support sub 205 mounts concentrically placed conduits 197 and 199. A shoulder at the upper end of bottom sub 205 contacts spring 204. Support sub 205 is connected on its lower end portion to an end sub 206. The interior of support sub 205 and end sub 206 are hollow and they cooperatively enclose a hollow, generally tubular pulse valve member 207. The interior of pulse valve member 207 and support sub 205 have a plunger member 208 mounted therebetween. Plunger 208 is threadedly mounted to support sub 205 at threaded joint 307 and slidably mounted inside the upper end of pulse valve member 207. Plunger 208 is threadedly connected into support sub 205 into abutment with a downardly facing shoulder 209. Plunger 208 remains stationary and the pulse valve members upper end portion moves up and down on the plunger's lower end portion.

First high pressure passage 196 in conduit 197 is in fluid communication with a hollow, longitudinally disposed passage in plunger 208. This fluid passage communicates with a port 212 transversely through the side of plunger 208 and in turn with a valve member raising fluid chamber 213. Valve member raising fluid chamber 213 is formed between support sub 205, end sub 206, and pulse valve member 207 as shown. The second high pressure fluid passage between conduits 197 and 199 is in fluid communication with a second high presure passage 214 in support of sub 205. Second high pressure passage 214 is in fluid communication with a valve member lowering fluid chamber 215 between support sub 205 and plunger 208.

A coil spring 223 is positioned around pulse valve member 207 and rests on an upwardly facing shoulder of end sub 206 to bias pulse valve member 207 in the upward direction or towards the retracted position. At the lower end portion of pulse valve member 207 a sleeve like valve member insert 224 extends upward into the interior of the valve member. A wear sleeve 225 is positioned around the exterior of valve member insert 224 and extending below the lower end of pulse valve member 207. Wear sleeve 225 is held in place between an upwardly facing shoulder of valve member insert 224 and lower end of pulse valve member 207. Wear sleeve 225 is a replaceable element constructed of a substantially wear resistant material such as tungsten carbide. This is necessary due to the high abrasion environment in which it operates as it restricts the mud flow through constriction ring 240 provided also of wear resistant material. When pulse valve member 207 is in the retracted position it resides substantially within a hollow housing 230 at the bottom of end sub 206.

It is important to note that the interior of pulse valve member 207 and valve sleeve member insert 224 are hollow and form a valve member internal passage 226 communicating with the lower end of plunger 208 for applying mud pressure to the interior of valve member 207 at surface 308 for balancing the effects of the mud pressure on the lower end of pulse valve member 207 at surface 309.

The upper portion of pulse valve member 207 is provided with a transversely disposed internal port 227 for communicating between high pressure port 212 and valve member raising fluid chamber 213. The upper end portion of pulse valve member 207 has an enlarged portion forming a piston 228 with its upper end resting against a downwardly facing shoulder in support sub 205 forming an upper limit stop.

The areas of surfaces 308 and 309 on valve member 207 are selected to be equal. The effective areas both above and below piston 228 are selected as being equal. An equal displacement of fluids is required to displace piston 228 from its upper position (as shown in FIG. 4H) to its lower position (as shown in FIG. 5).

The lower end portion of the instrument is mounted in instrument carrying drill collar 11 by a plurality of spaced apart vanes 235 extending outwardly of insert 230 and contacting an interior sidewall of the drill collar. Vanes 235 form a plurality of passages indicated generally at 236 for mud flowing in the annulus between the instrument housings in the interior of the drill collar. A support ring 237 is mounted to the lower end portions of vanes 235 and sized to slip within the internal diameter of drill collar 11 and support constriction ring 240 on its interior. Constriction ring 240 is a ring member constructed of an abrasive resistant material and retained in a fixed position in support ring 237 by a snap ring. Mud flows through passages 236 and through the internal opening of constriction ring 240. When pulse valve member 207 is in the retracted position as shown in FIG. 4H, mud flows through the constriction with no significant back pressure. When pulse valve member 207 is moved from a retracted position as shown in FIG. 4H to the extended position (downward most) as shown in FIG. 5, then back pressure of the mud within drill collar 11 is increased significantly thereby forming a pressure pulse that is detected by the receiving equipment at the earth's surface.

Figure 5:
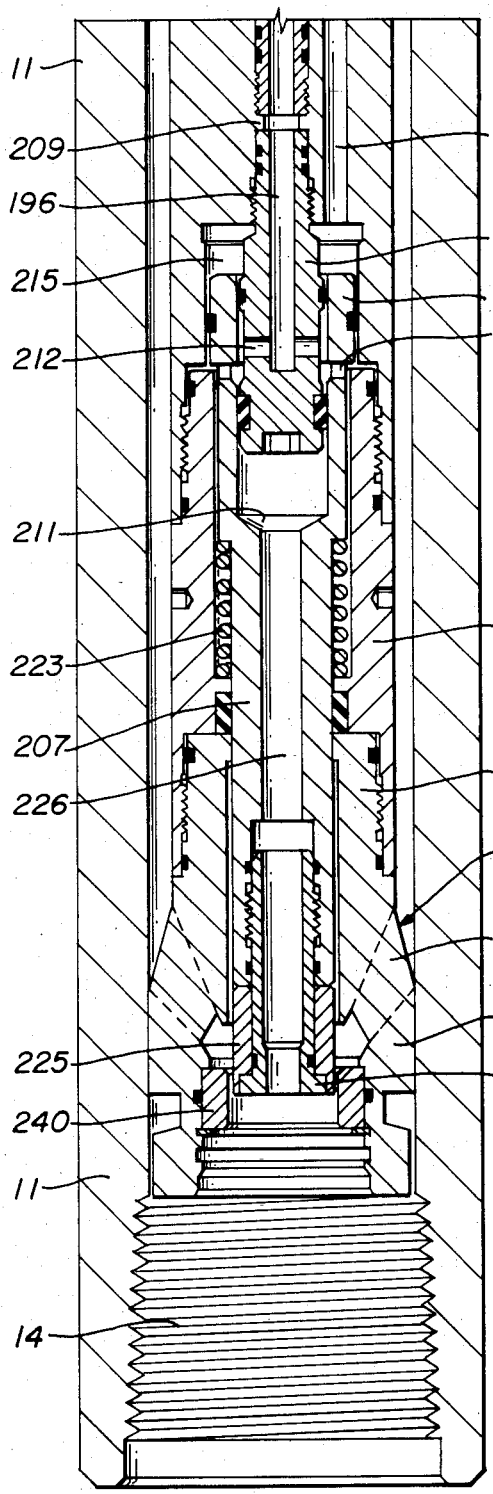
FIG. 5 is a cross sectional view of the valve end portion of the instrument, comparable to FIG. 4H, with the valve member in an extended position.

Referring to FIGS. 3, 4H and 5 operation of the pulse valve can be understood. When pulse valve member 207 is to be moved from the retracted position, shown in FIG. 4H, to the extended position, shown in FIG. 5, valve member 194 is shifted by solenoid 195 to the right from the position shown in FIG. 3 thereby applying high pressure fluid to chamber 215 and venting the fluid from chamber 213 via passageway 196 to hydraulic accumulator 200. When pulse valve member 207 is moved from the extended position to the retracted position solenoid 195 shifts valve member 194 to the left from the position shown in FIG. 3 thereby applying the high pressure simultaneously through passage 196 to chamber 213 and venting fluid from chamber 215 to accumulator 200.

As described above, the areas 308 and 309 and the piston areas of piston 228 in the pulse valve portion of the structure are selected to balance the influence of the mud pressure on pulse valve member 207 so that equal selected forces act on pulse valve member 207 to displace it both upward and downward. Pulse valve member 207 is not displaced by an increase in back pressure or pulse pressure occurring within the mud flow stream or the static mud pressure in the drill string. When pulse valve member is in either its extended or retracted position or at a location therebetween it will not have its displacement influenced by either the static or pulse pressures of mud in the drill string.

Figure 6:
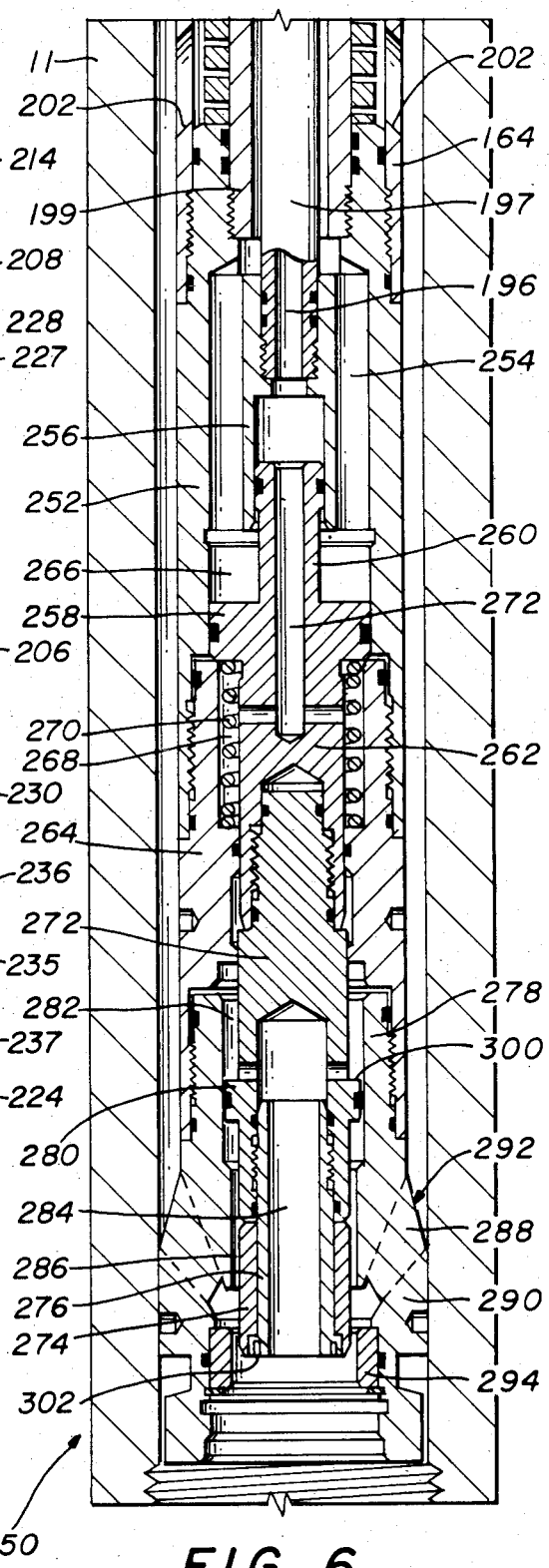
FIG. 6 is a cross sectional view of the valve end portion of the instrument only wherein it illustrates a second embodiment of the valve assembly of this invention with the valve member shown in an extended position.

A second embodiment of the pulse valve assembly of this invention is illustrated in FIG. 6. This second embodiment of the pulse valve assembly functionally operates the same as the first described embodiment insofar as being pressure balanced with respect to the mud pressure. However, it provides some modifications to the stuctural aspects of the invention in regard to the actuator for the valve member and the mechanism used to displace it between the extended and retracted positions. Corresponding portions of the instrument shown in FIG. 6 are the same as that previously described; thus it will not be described again. Some portions of the structure are the same as the portions utilized in the preceding description and those elements of the structure are provided with similar identifications and identifying numerals.

This second embodiment of the mud pressure pulse valve assembly is indicated generally at 250 and shown connected to adjoining portions of the instrument similar to that described above in conjunction with FIG. 4H of the first embodiment. The upper end portion of valve assembly 250 includes a support sub 252 that is attached to the lower end portions of conduit 197 and tubular housing segment 164 to form first and second high pressure hydraulic fluid passageways similar to that described above. The interior of conduit 197 forms the surrounding of portion of high pressure passageway 196. The second high pressure passage between conduit 197 and the interior of tubular housing segment 164 continues into support sub 252 at an annular passage 254. At the lower portion of conduit 197 is a sleeve member 256 axially disposed within support sub 252.

A piston 258 is longitudinally slidably mounted within support sub 252 and attached to pressure pulse valve member 272. Piston 258 and its surrounding cylinder form the valve actuator used for displacing valve 272 between a retracted and an extended position. Piston 258 has a central enlarged portion with a seal therearound and an upwardly extending tubular upper extension 260 having its upper end portion slidably and sealably mounted within sleeve 256. Piston 258 also has a downwardly disposed lower extension 262 extending into the interior of a housing end sub 264. The central portion of piston 258 resides in a cylinder that forms two separate piston chambers.

Piston chamber 266 is above the central portion of piston 258 and is used for lowering or extending pulse valve member 272. Below the central portion of piston 258 is another fluid chamber 268 used in raising piston 258 and moving pulse valve member 272 from its extended position to a retracted position. A coil spring 270 is positioned around piston lower extension 262 between an upwardly facing abutment and the lower side of piston 258 and biases piston 258 toward the upward direction or the retracted position of pulse valve member 272. A passageway 272 extends through piston upper extension 260 piston central portion 258, and connects with piston raising chamber 268 for communicating high pressure fluid to the lower side of piston 258 for moving it from the position shown in FIG. 6 to a retracted position similar to that illustrated in FIG. 4H. Second high pressure passage 254 is connected with valve piston lowering chamber 266 to apply high pressure fluid to the upper side of piston 258 to overcome the bias of spring 270 and displace pulse valve member 272 toward the downward direction or the extended position as shown in FIG. 6.

Pulse valve member 272 is mounted with lower end portion of piston 258 and it is enclosed within a hollow portion of end sub 264. Valve member 272 has at its lower end portion a valve wear sleeve 274 around its outer periphery secured in place by a valve member insert 276. An end sub insert end member 278 is secured to the lower end portion of end sub 264. End sub insert end member 278 is hollow and encloses the lower portion of valve member 272. An enlarged valve member seal 280 is provided around the mid portion of valve member 272 within end sub insert end member 278 forming a separation of fluid chambers within the end sub insert member. A pressure balance chamber 282 is formed above seal 280 within end sub insert end member 278.

A passageway 284 is provided through pulse valve member 272 between its lower end and a location above seal 280 whereupon it is open through the side of valve member 272 with pressure balance chamber 282. Passageway 284 provides a flow path for mud at the drill string pressure to surround valve member 272 and exert a downwardly directed force on the valve member at surface area 300 above the enlargement having seal 280. This force is in opposition to similar force exerted by the mud at the drill string pressure which acts in an upward direction on end surface area 302 of pulse valve member 272 by mud flowing through annular passage 286 around the lower end of valve member 272.

The annulus area of surface 300 and the circular area 302 of valve member 272 (indicated at the bottom of insert 276) are chosen to be substantially equal.

With this structure the static mud pressure within the drill string is exerted in both the upward and downward direction on valve member 272 thereby pressure balancing valve member 272 so that forces acting on piston 258 are only those forces that can be considered as the motive forces for valve member 272, the biasing force of spring 270 and friction forces.

It is to be noted that the effective area of piston 258 presented to lowering chamber 266 is larger than the effective area of the piston presented to raising chamber 268 and differs thereby from the previously described embodiment of FIG. 4H.

The external structure of end sub insert member 278 includes a plurality of spaced apart vanes 288 extending between a central portion of the end sub structure and a support ring 290 positioned within drill collar 11. Vanes 288 form a plurality of passages 292 that allow drilling mud to flow around the lower portion of this instrument. A constriction ring 294 is mounted within support ring 290 as shown so that wear ring sleeve 274 on the lower end portion of valve member 272 will be positioned within the constriction ring when the pulse valve member is in its extended position.

Operation of the valve actuator portion of this embodiment is similar to that discussed above and described in conjunction with FIG. 3.

Extending valve member 272 to the position illustrated is accomplished by activating the solenoid actuated valve 194 to direct high pressure oil or operating fluid into the second high pressure passage between conduits 197 and 199 and further into second high pressure passage 254 in support sub 252. High pressure fluid in this passage enters chamber 266 on the upper side of piston 258 and urges piston 258 and valve member 272 downward in opposition to spring 270. The hydraulic fluid from chamber 268 is vented through valve 194 to hydraulic accumulator chamber 200 as piston 258 moves downward. When it is desired to retract the valve member then solenoid actuated valve 194 is readjusted to direct high pressure fluid into conduit 197 and vent fluid pressure from the other conduit and passageway flow path to the hydraulic accumulator. The high pressure fluid in passage 196 enters passage 272 through piston 258 and chamber 268 below piston 258 in order to assist the upward biasing of spring 270 and in displacing piston 258 and valve member 272 in the upward direction.

When this occurs fluid from chamber 266 is vented through valve 194 to the hydrualic accumulator. Regardless of the direction of motion of valve member 272 and piston 258 there is mud within the interior of drill collar 11 is present upon both sides of valve member seal 280 thereby exerting balancing forces on the mud induced forces on valve member 272 as described. The mud caused forces affecting the movement of valve member 272 are due to the lower end portion of the valve member being in the mud flow stream. These forces are upwardly directed and are balanced by forces on the upper side of piston seal 280 in pressure balanced chamber 282. Therefore the opposition to movement of valve member 272 is limited to frictional resistance in moving the elements involved and force necessary to overcome spring 270. Because valve member 272 is pressure balanced with respect to mud pressures in the drill string it can be easily moved by the hydraulic system of this instrument without being restrained in any position due to a pressure differential caused by the mud static pressure or the mud flow rate.

Both of the above described embodiments of valve assemblies in this invention function similarly to create pressure pulses in the mud flow stream within the well drill string for transmitting data through the mud flow system to the earth's surface for recovery at the earth surface by the measurement while drilling apparatus.

Both of the embodiments described herein overcome the shortcomings of some prior art devices by having the valve member thereof physically arranged in a pressure balanced condition so that mud pressures within the drill string will not tend to stop or restrain motion of this valve member.

The embodiment of FIG. 4H additionally provides both equal effective areas on the motive piston and equal volumes of displacement fluid for actuation.

It is to be noted that the hydraulic circuits shown can be replaced by other hydraulic circuits that will supply the operating or hydraulic fluid at the desired sequence to actuate the valve member. It is not necessary that the hydraulic circuits include the specific combination of elements shown and described herein. For example, the pump can be replaced with an alternate hydraulic power source such as a reciprocating piston mounted in a cylinder and the four way valve can be replaced with other valve configurations to accomplish the fluid flow changes within the circuit.

The embodiments of the invention in which an exclusive property or privilege is claimed are defined as follows:

1. In a measurement while drilling system for borehole drilling having a downhole instrument connectable in a drill string of a rotary drilling rig including apparatus to sense geological and geophysical parameters and a valve apparatus to pulse modulate drilling fluid flowing in said drill string, and surface apparatus connected to a drilling fluid flow conductor for extracting intelligence carrying information from the modulated drilling fluid, an improved valve apparatus comprising:

(a) a drilling fluid flow pulse modulating pressure pulse valve member longitudinally, movably mounted in a body member and movable from a retracted position substantially removed from the drilling fluid flow and an extended position disposed at least partially within the drilling fluid flow thereby temporarily restricting drilling fluid flow within the drill string;

(b) said pulse valve member is a tubular member having a lower end portion displaceable from said body member into said drilling fluid and an upper end portion with opposed fluid pressure force areas thereon being in fluid communciation with the drilling fluid flow such that forces due to said drilling fluid acting on said pressure pulse valve member are balanced in a longitudinal direction;

(c) said pulse valve member has a recess in an upper end portion thereof for receiving therein a plunger portion of said actuator;

(d) a seal assembly operably mounted between said body member and said pulse valve member sealably separating the exterior of said tubular member lower end portion that is immersed in said drilling fluid from upper portions of said pulse valve member;

(e) an actuator mounted with said pulse valve member and having means to move said pulse valve member longitudinally between said extended and retracted positions independent of pressures of the drilling fluid acting on said pulse valve member to a normally retracted position;

(f) said actuator has a plunger portion mounted in said body member and extending into said pulse valve member upper end portion recess; a seal assembly mounted in said body member contacts a mid portion of the pulse valve member and another seal assembly on said plunger of said actuator contact an interior surface of said pulse valve member separating said mud flow within said pulse valve member from said actuator, said seal assemblies being located on said pulse valve member in positions defining equal pressure force areas that are equal in area and opposite in force producing direction in order to force balance said pulse valve member with respect to the drilling fluid; and (g) said actuator and said means to move said pulse valve member include a piston and cylinder formed therebetween within said body member and displaceable by fluid pressure on opposite effective sides thereof to displace said pulse valve member.

2. The improvement of claim 1, wherein:

(a) said actuator includes an annular chamber between said plunger and said body containing an annular piston that is secured to the upper end of said pulse valve member;

(b) said annular chamber has an upper portion above said annular piston in fluid communication with a hydraulic circuit for displacing said annular piston and said pulse valve member in an extended direction to position an end portion of pulse valve member in said drilling fluid flow to temporarily restrict drilling fluid flow;

(c) said annular chamber has a lower portion below said annular piston, and said pulse valve member has a transverse opening therethrough below said annular piston providing fluid communication in said annular chamber lower portion between both inner and outer sides of said pulse valve member;

(d) said plunger is hollow and has an opening through the side thereof in fluid communication with said hydraulic circuit and said annular chamber lower portion; and (e) a coil spring biased in compression is positioned around said pulse valve member between an abutment therearound and a facing abutment in said body member in order to bias said pulse valve member toward a retracted position.

3. The improvement of claim 1 wherein:

(a) said pulse valve member has a hollow lower end portion that is displaceable from said body into said drilling fluid and an upper end portion secured to a piston of said actuator; and (b) said pulse valve member has a seal assembly around a mid portion thereof forming a pressure balance chamber between said pulse valve member and said body that is communicably connected to the drilling fluid through the hollow interior of said pulse valve member and a pressure balance fluid chamber around said pulse valve member between said seal assembly within a lower end portion of said body and also in fluid communication with the drilling fluid wherein both of said fluid chambers are selected to substantially balance the drilling fluid induced forces on said pulse valve member in its longitudinal direction.

4. The improvement of claim 3 wherein:

(a) said actuator includes a piston chamber within said body located above said pulse valve member;

(b) said piston has a central portion sealably and longitudinally slidably mounted in said piston chamber; and upper piston portion of a reduced diameter extending into a sleeve mounted in said body and connected in fluid communication with a hydraulic circuit; and a lower portion of a reduced diameter secured to said pulse valve member, said piston having a passageway therethrough from the upper end thereof to a mid portion of said lower portion thereof for communicating hydraulic fluid from said hydraulic circuit with said pressure balance chamber; and (c) a coil spring biased in compression is positioned around said pulse valve member between a lower surface of said piston and an upwardly facing abutment in said body member to bias said pulse valve member toward said retracted position.

5. A measurement while drilling apparatus for use in a drill string to form a signal indicative of downhole drilling information comprising:

(a) an elongated tubular outer body terminating in an upper and a lower connective end means for connecting said tubular body in a drill string of an earth borehole drilling apparatus;

(b) an inner body received of and mounted within said outer body;

(c) means for positioning said inner body within said elongated tubular body to define an annular mud flow space around said inner body on the interior of said outer body;

(d) turbine means for intercepting the flow of mud through said annular space and operable to extract energy from the mud flow and rotation of a shaft;

(e) a hydraulic pump connected to said shaft for pumping hydraulic fluid at an elevated pressure in a hydraulic circuit;

(f) a controllable valve means in said hydraulic circuit;

(g) a longitudinally movable piston received in a cylinder in said body and hydraulically connected to said controllable valve means in said hydraulic circuit;

(h) a pulse valve member mounted with said movable pistone being tubular in a lower end portion with said lower end portion displaceable from said body into said drilling fluid and having an upper end portion with opposed fluid pressure force areas thereon located such that drilling fluid pressure forces act on such that forces due to pressure forces acting on said pulse valve member are balanced in a longitudinal direction and having a seal assembly operably mounted between said body member and said pulse valve member sealably separating the exterior of said tubular member lower end portion that is immersed in said drilling fluid from upper portions of said pulse valve member;

(i) said pulse valve member is connected to an actuator having a first piston portion having an upper side and a lower side each being in fluid communication with said hydraulic circuit to receive high pressure fluid for displacing said piston and said pulse valve member between said retracted position and said extended position;

(j) said pulse valve member has a second piston portion exposed to mud at a pressure substantially the same as mud pressure at said end portion, with said second piston portion positioned to direct force on said pulse valve member in balanced opposition to force due to mud flow at said pulse valve member end portion;

(k) said pulse valve member is a tubular member having a lower end portion displaceable from said body into said drilling fluid and having a hollow upper end portion receiving therein a plunger of said actuator;

(l) said seal assembly includes a seal element mounted in said inner body contacting an exterior mid portion of said pulse valve member; and another seal assembly on said plunger positioned around an interior surface of said pulse valve member separates said mud flow within said pulse valve member from said actuator, said seal assemblies being located on said pulse valve member in positions defining equal pressure force areas thereon;

(m) said hydraulic circuit being connected to said hydraulic pump utilizing hydraulic fluid flowing in hydraulic conduits through said controllable valve means to said piston and cylinder for moving said piston between retracted and extended positions to displace said pressure pulse valve member between retracted and extended positions; and (n) a constrictive passage in said annular mud flow space located such that mud flowing through said annular space is directed through said constrictive passage and said constrictive passage being positioned such that an end portion of said pressure pulse valve member can enter the opening thereof to vary the restriction of mud flow through said tubular body in order to modulate the flow of mud and thereby form a pressure signal dependent upon manipulation of said controllable valve means that is indicative of downhole drilling information.

6. The improvement of claim 5, wherein:

(a) said first piston portion comprises an annular piston secured to the upper end of said pulse valve member residing in an annular chamber surrounding a downwardly extending plunger;

(b) said annular chamber has an upper portion above said annular piston in fluid communication with said hydraulic circuit for displacing said annular piston and said pulse valve member in the extended direction;

(c) said annular chamber has a lower portion below said annular piston; and said pulse valve member has a transverse opening therethrough below said annular piston providing fluid communication in said annular chamber lower portion between inner and outer sides of said pulse valve member;

(d) said plunger is hollow and has a passageway therethrough opening on the side thereof and being in fluid communication with said hydraulic circuit and said annular chamber lower portion; and (e) a coil spring biased in compression is positioned around said pulse valve member between an abutment therearound and a facing abutment in said inner body member in order to bias said pulse valve member toward said retracted position.

7. The improvement of claim 5 wherein:

(a) said pulse valve member has a seal assembly around a mid portion interposed between said first piston portion and said pulse valve member hollow lower end forming above said seal assembly a pressure balance chabmer between said pulse valve member and said inner body with said pressure balance fluid chamber being in fluid communication with the interior of said pulse valve member hollow lower end portion, and another said fluid chamber below said seal assembly in fluid communication with the mud flow within a lower end portion of said inner body said seal assembly constructed with both of said fluid chambers are selected to substantially balance the mud flow induced forces on said pulse valve member in its longitudinal direction thereby pressure balancing said pulse valve member with respect to the mud flow.

8. The improvement of claim 7, wherein:

(a) said actuator includes an actuator piston chamber within said inner body located above said pulse valve member;

(b) said actuator piston has a central portion sealably and longitudinally slidably mounted in said piston chamber; an upper piston portion of a reduced diameter extending into a sleeve mounted in said body and being in fluid communication with a hydraulic circuit; and a lower portion of a reduced diameter secured to said pulse valve member, said actuator piston having a passageway therethrough from the upper end thereof to a mid portion of said lower portion thereof for communicating hydraulic fluid from said hydraulic circuit with said pressure balance chamber; and (c) a coil spring biased in compression is positioned around said pulse valve member between a lower surface of said piston and an upwardly facing abutment in said inner body member to bias said pulse valve member toward said retracted position.

* * * * *